US010983467B2

(12) United States Patent
Matsumoto

(10) Patent No.: US 10,983,467 B2
(45) Date of Patent: Apr. 20, 2021

(54) IMAGE FORMING SYSTEM AND CONTROL METHOD

(71) Applicant: Konica Minolta, Inc., Tokyo (JP)

(72) Inventor: Hideki Matsumoto, Okazaki (JP)

(73) Assignee: KONICA MINOLTA, INC., Tokyo (JP)

( * ) Notice: Subject to any disclaimer, the term of this patent is extended or adjusted under 35 U.S.C. 154(b) by 379 days.

(21) Appl. No.: 16/173,228

(22) Filed: Oct. 29, 2018

(65) Prior Publication Data

US 2019/0146393 A1 May 16, 2019

(30) Foreign Application Priority Data

Nov. 10, 2017 (JP) ..... JP2017-216942

(51) Int. Cl.
*G03G 15/00* (2006.01)

(52) U.S. Cl.
CPC ..... *G03G 15/5029* (2013.01); *G03G 15/6541* (2013.01); *G03G 15/6573* (2013.01); *G03G 15/6582* (2013.01); *G03G 2215/00734* (2013.01); *G03G 2215/00742* (2013.01); *G03G 2215/00827* (2013.01); *G03G 2215/00831* (2013.01)

(58) Field of Classification Search
CPC ..... G03G 15/5029
USPC ..... 399/410
See application file for complete search history.

(56) References Cited

U.S. PATENT DOCUMENTS 7,590,362 B2 * 9/2009 Yamauchi ..... G03G 15/5004 399/18
2008/0124108 A1 * 5/2008 Tokuyama ..... G03G 15/0849 399/62
2008/0174825 A1 * 7/2008 Hatakeyama ..... B42C 11/04 358/1.18
2010/0090388 A1 * 4/2010 Toyoizumi ..... B65H 29/60 270/58.07
2013/0147106 A1 * 6/2013 Tamura ..... G03G 15/6547 270/58.07

(Continued)

FOREIGN PATENT DOCUMENTS

JP 2007-176695 A 7/2007
JP 2014-089486 A 5/2014
JP 2014-118236 A 6/2014

*Primary Examiner* — Anthony H Nguyen
(74) *Attorney, Agent, or Firm* — Lucas & Mercanti, LLP

(57) ABSTRACT

An image forming apparatus detects an attribute of paper for each sheet of paper. A post-process apparatus performs a post-process for each group of paper including a designated number of sheets of paper. A controller of the image forming apparatus determines for each sheet of paper, whether or not a designated post-process is prohibited based on prohibition rule data which defines permission and prohibition of the post-process in accordance with the attribute of paper for each type of post-process and the detected attribute of paper. When the controller determines that the designated post-process is prohibited, the controller determines whether or not a sheet of paper which resulted in determination as prohibition is a sheet of paper intermediate between the first sheet of paper and the last sheet of paper in the group of paper, and has an image forming system perform a process in accordance with a result of determination.

22 Claims, 7 Drawing Sheets

(56) References Cited

U.S. PATENT DOCUMENTS

2014/0154030 A1* 6/2014 Kimura ..... B65H 37/04
412/1

* cited by examiner

IMAGE FORMING SYSTEM AND CONTROL METHOD

The entire disclosure of Japanese Patent Application No. 2017-216942 filed on Nov. 10, 2017 is incorporated herein by reference in its entirety.

BACKGROUND

Technological Field

The present disclosure relates to an image forming system including a post-process apparatus and a control method in an image forming system.

Description of the Related Art

An image forming system including a post-process apparatus and an image forming apparatus has conventionally been known.

Such an image forming system is set not to start a printing job when a post-process such as a stapling process is selected while thick paper (cardboard) having a thickness or a basis weight equal to or higher than a prescribed level is selected as paper (sheet) to which an image is to be transferred.

When paper having a size different from a prescribed size (which is also referred to as "error paper" below) is mixed in a paper bundle to be post-processed (for example, a group of paper to be stapled in one bundle in a stapling process), the group of paper is often not used as an output product. Therefore, an image forming system configured to stop a post-process in such a case has also be known.

For example, an image forming system disclosed in Japanese Laid Open Patent Publication No. 2014-118236 controls whether or not to prohibit a stitching process by stitching means based on sheet information on at least one of a type, a thickness, and a basis weight of a sheet included in a paper bundle (a sheet bundle) to be stitched. Specifically, the linage forming system prohibits the stitching process when a plurality of sheets different in sheet information are included in a paper bundle.

An image forming system disclosed in Japanese Laid-Open Patent Publication No. 2014-89486 (specifically, a sheet buffer apparatus) includes buffer means for performing a buffer process for holding paper to be transported to a post-process unit and laying a subsequent sheet of paper over the paper, determination means for determining whether or not paper is paper of which buffer process by the buffer means has been prohibited, and control means for prohibiting, when the determination means determines that paper subsequent to paper to be held is paper of which buffer process has been prohibited, holding of the paper to be held.

SUMMARY

The conventional image forming system has been configured to immediately cancel a post-process when it determines that paper is not prescribed paper. Therefore, no post-process is performed on a paper bundle subsequent to a paper bundle to be stitched including such paper. Therefore, an output product desired by a user cannot be obtained. Consequently, the user inevitably has to set again the post-process.

The present disclosure was made in view of the problems above, and an object in one aspect is to provide an image forming system which allows a flexible process even when paper which is not prescribed paper is included and a control method.

To achieve at least one of the abovementioned objects, according to an aspect of the present invention, an image forming system reflecting one aspect of the present invention comprises an image forming apparatus and a post-process apparatus configured to perform a designated post-process among a plurality of types of post-processes. The image forming apparatus includes a controller configured to control the image forming apparatus and the post-process apparatus and a detector configured to detect an attribute of paper led from the image forming apparatus to the post-process apparatus for each sheet of paper. The post-process apparatus is configured to perform a post-process for each group of paper including a designated number of sheets of paper. The controller is configured to store prohibition rule data which defines permission and prohibition of the post-process in accordance with the attribute of the paper for each type of the post-process. The controller is configured to accept input of designation of a post-process to be performed by the post-process apparatus among the plurality of types of post-processes. The controller is configured to determine for each sheet of paper, whether or not the designated post-process is prohibited based on the prohibition rule data and the detected attribute of the paper. When the controller determines that the designated post-process is prohibited, the controller is configured to determine whether or not paper which resulted in determination as the prohibition is a sheet of paper intermediate between a first sheet of paper and a last sheet of paper in the group of paper and to have the image forming system perform a process in accordance with a result of determination.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
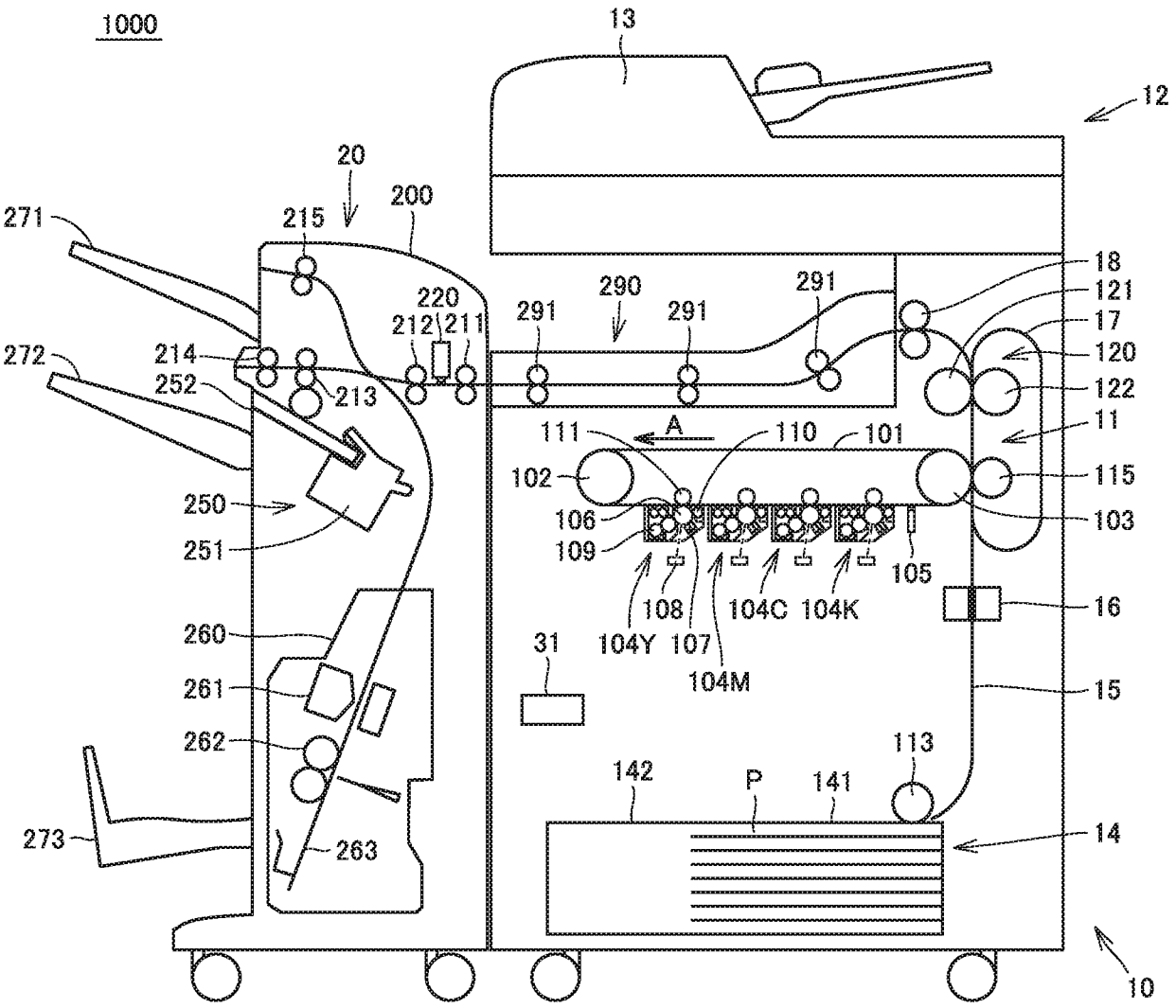
FIG. 1 is a schematic diagram showing an internal configuration of an image forming system.

Hereinafter, one or more embodiments of the present invention will be described with reference to the drawings. However, the scope of the invention is not limited to the disclosed embodiments.

An image forming apparatus in an embodiment will be described below with reference to the drawings. When the number and an amount are mentioned in the embodiment described below, the scope of the present invention is not necessarily limited to the number and the amount unless otherwise specified. The same or corresponding elements have the same reference numerals allotted and redundant description may not be repeated. The drawings are not to scale, and for facilitating understanding of a structure, the drawings may be modified in scale for clarification of the structure.

<A System Configuration>

FIG. 1 is a schematic diagram showing an internal configuration of an in forming system 1000. Referring to FIG. 1, image forming system 1000 includes an image forming apparatus 10 and a post-process apparatus 20.

(a1. Image Forming Apparatus 10)

Image forming apparatus 10 includes a multi function peripheral (MFP) provided with a scanner function, a copying function, a printer function, a facsimile function, a data communication function, and a server function. Image forming apparatus 10 can execute a copying job, a printing job, a scanning job, a fax job, and a box job.

Image forming apparatus 10 includes an image forming unit 11, a document scanning unit 12, an automatic document transportation unit 13, a paper feed unit 14, a transportation path 15, a detector 16, a reverse transportation path 17, and a paper ejection roller 18. Image forming apparatus 10 further includes a controller 31 configured to control image forming apparatus 10 and post-process apparatus 20. Image forming apparatus 10 is what is called a tandem type color printer. Image forming apparatus 10 forms an image based on print setting.

Automatic document transportation unit 13 automatically transports a document placed on a platen to a scanning position in the document scanning unit.

Document scanning unit 12 scans an image of the document transported by automatic document transportation unit 13 and generates scanning data.

Paper feed unit 14 includes a paper feed roller 141 and a paper feed cassette 142. Paper feed cassette 142 accommodates paper P. Paper feed roller 141 sends paper P upward along transportation path 15.

Transportation path 15 is used in single-side printing and double-side printing. Reverse transportation path 17 is used in double-side printing. In the present example, reverse transportation path 17 may be used also in single-side printing, although details will be described later.

Image forming unit 11 forms an image on paper P supplied by paper feed unit 14 based on scanning data generated by document scanning unit 12 or printing data obtained by a data interface (IF) unit.

Image forming unit 11 includes an intermediate transfer belt 101, registration rollers 102 and 103, a yellow image forming unit 104Y, a magenta image forming unit 104M, a cyan image forming unit 104C, a black image forming unit 104K, an image density sensor 105, a primary transfer apparatus 111, a secondary transfer apparatus 115, and a fixation apparatus 120. Fixation apparatus 120 includes a heating roller 121 and a pressurization roller 122.

Intermediate transfer belt 101 is am endless belt member. Intermediate transfer belt 101 has opposing ends supported by registration rollers 102 and 103. Image forming units 104Y, 104M, 104C, and 104K of respective colors and image density sensor 105 are arranged under intermediate transfer belt 101.

Image forming unit 104Y includes a photoconductor drum 106, a charging apparatus 107, an exposure apparatus 108, a development apparatus 109, and a cleaner apparatus 110. Charging apparatus 107, exposure apparatus 108, development apparatus 109, and cleaner apparatus 110 are arranged around photoconductor drum 106. Image forming units 104M, 1040, and 104K are also similar in hardware configuration to image forming unit 104Y.

Primary transfer apparatus 111 is arranged at a position opposed to photoconductor drum 106 with intermediate transfer belt 101 being interposed. Secondary transfer apparatus 115 is arranged at a position facing registration roller 103 with transportation path 15 being interposed. Detector 16 is arranged between transportation path 15 and secondary transfer apparatus 115.

Detector 16 detects an attribute of paper P (characteristics such as a type of paper). Detector 16 outputs, for example, an attribute of paper as a numeric value. Detector 16 will be described below as detecting a basis weight of paper P by way of example.

Specifically, detector 16 includes a light emission unit which emits light to paper P and a light reception unit which receives tight reflected from paper P. Detector 16 determines a basis weight of paper based on a voltage value of the reflected light.

An attribute of paper P (a thickness, a moisture content, and a surface property) may be detected by using a displacement sensor which detects a thickness of paper P, a capacitance sensor which detects a moisture content of paper P, a camera which picks up an image of a surface property of paper P, or an ultrasonic sensor instead of detector 16.

Paper ejection roller 18 is arranged further downstream from fixation apparatus 120 in transportation path 15. Paper P ejected from paper ejection roller 18 is sent to a horizontal transportation unit 290 of post process apparatus 20.

An operation by image forming apparatus 10 will now be described. Upon receiving an instruction to form an image, image forming apparatus 10 generates color image data from an image signal. The generated color image data is sent to corresponding image forming units 104Y, 104M, 104C, and 104K. Color image forming units 104Y, 104M, 104C, and 104K each form an electrostatic latent image by charging and exposing photoconductor drum 106 based on the image data. Image forming units 104Y, 104M, 104C, and 104K each form a toner image by developing the formed electrostatic latent image.

The formed toner images are successively transferred to intermediate transfer belt 101 by primary transfer apparatuses 111 and superimposed on one another. Simultaneously, paper P is sent upward along transportation path 15 from paper feed unit 14. The toner images superimposed on intermediate transfer belt 101 are transferred to paper P by secondary transfer apparatus 115. Paper P which carries the toner image is further transported to reach fixation apparatus 120, and the paper is heated and pressurized by fixation apparatus 120. The toner image is thus fixed to paper P. Paper P to which the toner image has been fixed is ejected to horizontal transportation unit 290 by paper ejection roller 18.

Paper P to which front surface the toner image has been fixed by fixation apparatus 120 is ejected as it is in single-side printing. In double-side printing, the paper is transported again to secondary transfer apparatus 115 through reverse transportation path 17, has an image formed on a rear surface thereof, and thereafter is ejected.

(a2. Post-Process Apparatus 20)

Post-process apparatus 20 includes a main body portion 200 and horizontal transportation unit 290. Main body portion 200 mainly includes a registration roller 211, an intermediate roller 212, an accommodation roller 213, a main tray ejection roller 214, a sub tray ejection roller 215, a punching apparatus 220, a side-stitching process unit 250, a saddle-stitching process unit 260, a sub tray 271, a main tray 272, and a lower tray 273.

Horizontal transportation unit 290 includes a plurality of horizontal transportation rollers 291. Horizontal transportation unit 290 sends paper P ejected from paper ejection roller 18 to main body portion 200 of post-process apparatus 20 by means of horizontal transportation rollers 291.

Main body portion 200 performs a post-process for each group of paper (which is also referred to as a "paper bundle B" below) including a designated number of sheets of paper. For example, main body portion 200 performs a punching (perforation) process, a sorting process, a stitching process (a stapling process), or a folding process as the post-process on a group of paper sent from horizontal transportation unit 290. The stitching process includes a side-stitching process and a saddle-stitching process.

By way of example, when a user inputs an instruction to generate ten sets of copies of six sheets of paper to image forming apparatus 10 while a side-stitching process has been set, main body portion 200 generates ten sets of copies by repeating ten times, a process for stapling six sheets of paper P (a group of paper including a designated number of sheets of paper) into one set.

Main body portion 200 can perform such processes as being combined in accordance with setting made by at user. For example, main body portion 200 can perform the folding process and the stitching process (specifically, the saddle-stitching process) on paper bundle B.

Side-stitching process unit 250 performs the side-stitching process on paper bundle B. Side-stitching process unit 250 includes a side-stitching stapler 251 and a main process tray 252.

Side-stitching process unit 250 drives registration roller 211, intermediate roller 212, and accommodation roller 213 to transport paper P sent from horizontal transportation unit 290 in a direction toward main tray 272 at a prescribed speed. When side-stitching process unit 250 completes side-stitching operations onto paper bundle B, it drives main tray paper ejection roller 214 and ejects paper bundle B subjected to the side-stitching process to main tray 272.

Saddle-stitching process unit 260 performs the saddle-stitching process on paper bundle B. Saddle-stitching process unit 260 includes a saddle-stitching stapler 261, at folding roller 262, and a saddle process tray 263.

Transportation of paper P to saddle-stitching process unit 260 is such that paper P sent one by one from horizontal transportation unit 290 to main body portion 200 is switched back and paper P is stacked on saddle process tray 263. When saddle-stitching process unit 260 completes an operation to stack and align the last sheet of paper in paper bundle B, it moves paper bundle B to a saddle-stitching position. When saddle-stitching process unit 260 completes movement to the saddle-stitching position, it drives saddle-stitching stapler 261 and performs a stitching operation at a prescribed position in paper bundle B.

<B. Overview of Process>

Figure 2:
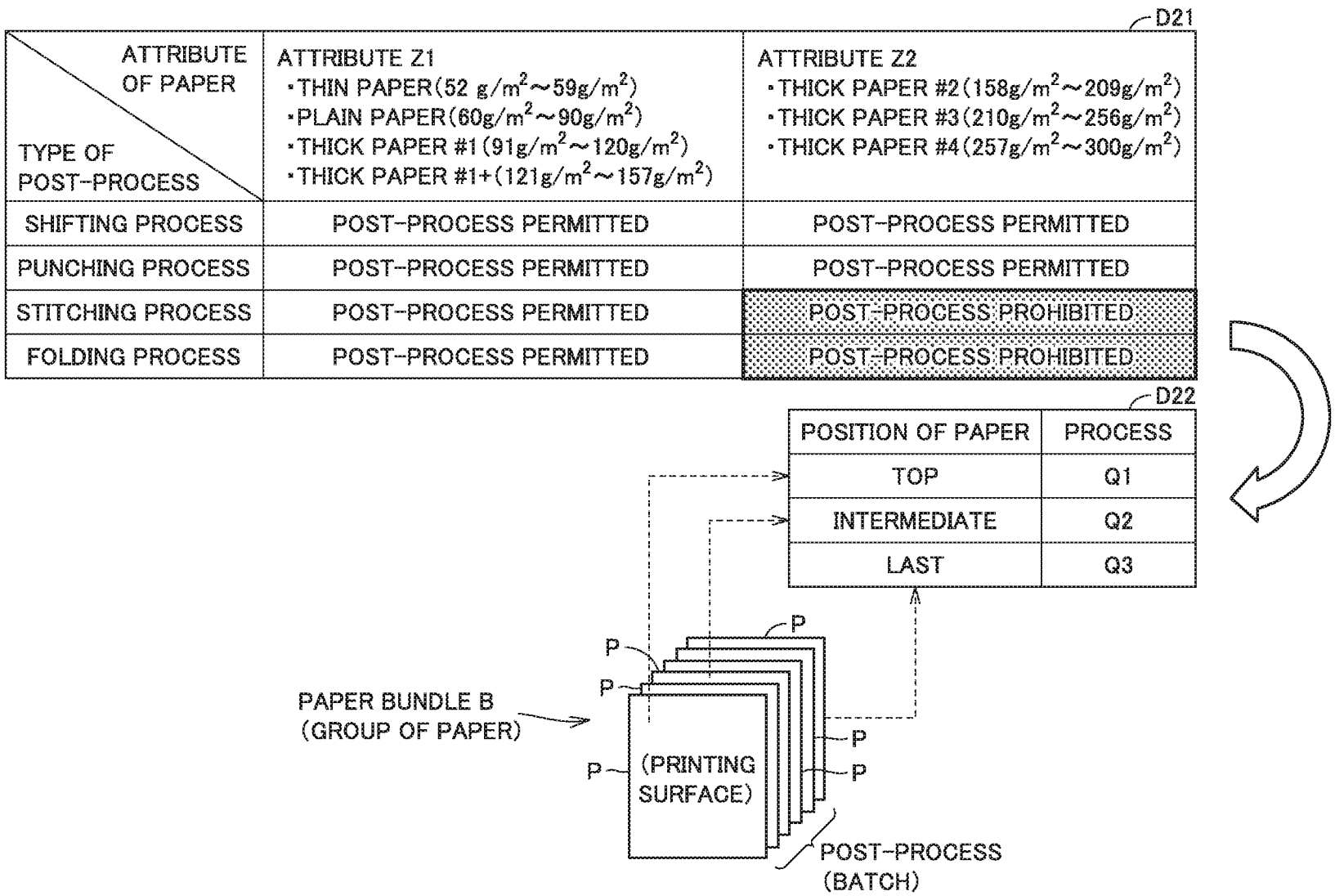
FIG. 2 is a diagram for illustrating overview of a process performed in the image forming system.

FIG. 2 is a diagram for illustrating overview of a process performed in image forming system 1000.

Referring to FIG. 2. controller 31 included in image forming apparatus 10 stores prohibition rule data D21 and process content definition data D22. Controller 31 controls operations by image forming apparatus 10 and operations by post-process apparatus 20 by referring to such data D21 and D22.

Prohibition rale data D21 defines permission and prohibition of a post-process in accordance with an attribute of paper for each type of post-processes. Prohibition rule data D21 defines a shifting process, a punching process, a stitching process (side-stitching and saddle-stitching), and a folding process as types of post-processes. These are by way of example and the types of post-processes defined in prohibition rule data D21 are not limited to the four types.

In image forming apparatus 10, a basis weight of paper is managed under a plurality of categories. In accordance with a result of detection by detector 16, controller 31 categorizes paper into "thin paper," "plain paper," "thick paper #1," "thick paper #1+," "thick paper #2," "thick paper #3," and "thick paper #4" in the ascending order of thickness.

For example, in the present example, the "thin paper" is defined as paper having a basis weight not smaller than 52 g/m$^2$ and not greater than 59 g/m$^2$. The "plain paper" is defined as paper having a basis weight not smaller than 60 g/m$^2$ and not greater than 90 g/m$^2$. Similarly, "thick paper #1," "thick paper #1+," "thick paper #2," "thick paper #3," and "thick paper #4" are defined as paper having a basis weight not smaller than 91 g/m$^2$ and not greater than 120 g/m$^2$, paper having a basis weight not smaller than 121 g/m$^2$ and not greater than 157 g/m$^2$, paper having a basis weight not smaller than 158 g/m$^2$ and not greater than 209 g$^2$, paper having a basis weight not smaller than 210 g/m$^2$ and not greater than 256 g/m$^2$, and paper having a basis weight not smaller than 257 g/m$^2$ and not greater than 300 g/m$^2$, respectively.

In prohibition rule data D21, the attribute of paper is categorized into two based on a basis weight of paper P. A first attribute Z1 is defined as a basis weight of paper not greater than 157 g/m$^2$ and a second attribute Z2 is defined as a basis weight of paper not smaller than 158 g/m$^2$.

Examples of paper having a basis weight not greater than 157 g/m$^2$ include thin paper, plain paper, thick paper #1, and thick paper 1+. Examples of paper having a basis weight not smaller than 158 g/m$^2$ include thick paper #2, thick paper #3, and thick paper #4.

In prohibition rule data D21, for paper having attribute Z1, four types (all types) of the post-processes are permitted. In prohibition rule data D21, for paper having attribute Z2, two post-processes of the shifting process and the punching process are permitted whereas two processes of the stitching process and the folding process are prohibited in principle. In spite of input to set the stitching process from a user, when paper has attribute Z2, a post-process such as the stitching process of paper bundle B is not permitted in principle. Exceptions will be described later.

Controller 31 determines a position of paper having attribute Z2 when paper having attribute Z2 is detected while the stitching process or the folding process has been set. Specifically, controller 31 determines whether paper having attribute Z2 is the first sheet of paper, an intermediate sheet of paper, or the last sheet of paper in paper bundle B (a group of paper).

Controller 31 has image farming apparatus 10 or post-process apparatus 20 perform a process in accordance with a position of paper having attribute Z2 by referring to process content definition data D22. For example, when the position of paper is the top in paper bundle B, controller 31 performs a process Q1. When the position of the paper is intermediate in paper bundle B (in FIG. 2, second to fifth sheets of paper), controller 31 performs a process Q2. When the position of paper is the last in paper bundle B (in FIG. 2, the sixth sheet), controller 31 performs a process Q3.

According to such a configuration, depending on setting contents in processes Q1, Q2, and Q3, a flexible process can be performed even though a group of paper includes paper having attribute Z2. Specific examples of processes Q1, Q2, and Q3 will be described later.

An example in which the side-stitching process is set as a mode of the post-process selected by a user will be described below for the sake of convenience of description. It is assumed that the side-stitching process is performed for each group of paper (paper bundle B) including sheets of paper in number designated by a user.

<C. Hardware Configuration>

Figure 3:
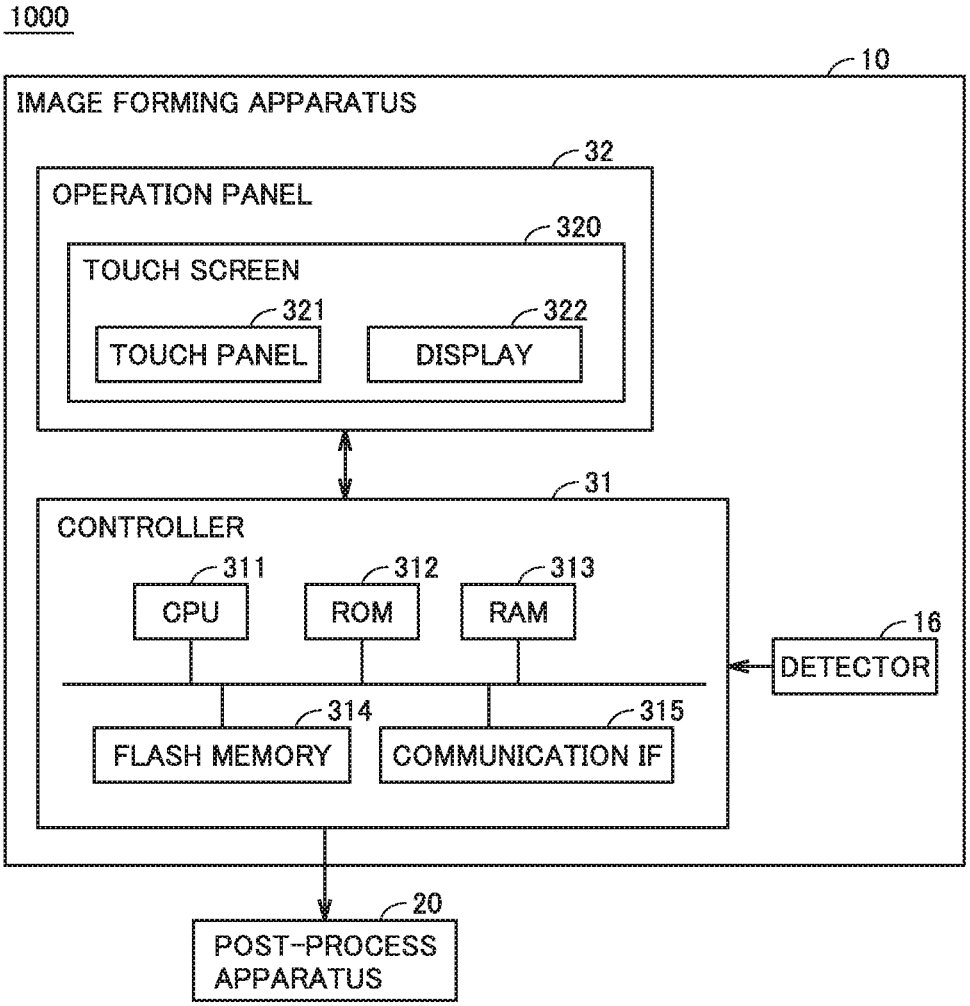
FIG. 3 is a block diagram for illustrating a hardware configuration of an image forming apparatus.

FIG. 3 is a block diagram for illustrating a hardware configuration of image forming apparatus 10.

Referring to FIG. 3, image forming apparatus 10 includes at least controller 31, an operation panel 32, and detector 16.

Operation panel 32 includes a touch screen 320. Touch screen 320 is constituted of a display 322 and a touch panel 321 arranged as being superimposed on display 322.

Setting for a post-process is made, for example, through touch screen 320. A user selects an item (an object image) of a post-process the user desires so that controller 31 makes setting for the post-process. Controller 31 sets, for example, the side-stitching process.

Controller 31 includes a central processing unit (CPU) 311 configured to execute a program, a read only memory (ROM) 312 configured to store data in a non-volatile manner, a random access memory (RAM) 313 configured to store data in a volatile manner, at flash memory 314, and a communication IF 315. Controller 31 can communicate with detector 16, operation panel 32, and post-process apparatus 20 through communication IF 315.

Flash memory 314 is a non-volatile semiconductor memory. Flash memory 314 stores an operating system and various programs executed by CPU 311, various contents, and data. Flash memory 314 stores in a volatile manner, various types of data such as data generated by image forming apparatus 10 and data obtained from an apparatus outside image forming apparatus 10.

Controller 31 determines whether paper is "thin paper," "plain paper," "thick paper #1," "thick paper #1+," "thick paper #2," "thick paper #3," or "thick paper #4" based on a result of detection by detector 16. Controller 31 further determines whether paper has attribute Z1 or attribute Z2.

Controller 31 has post-process apparatus 20 perform a process based on a result of determination of attribute in one aspect.

<D. Functional Configuration>

Figure 4:
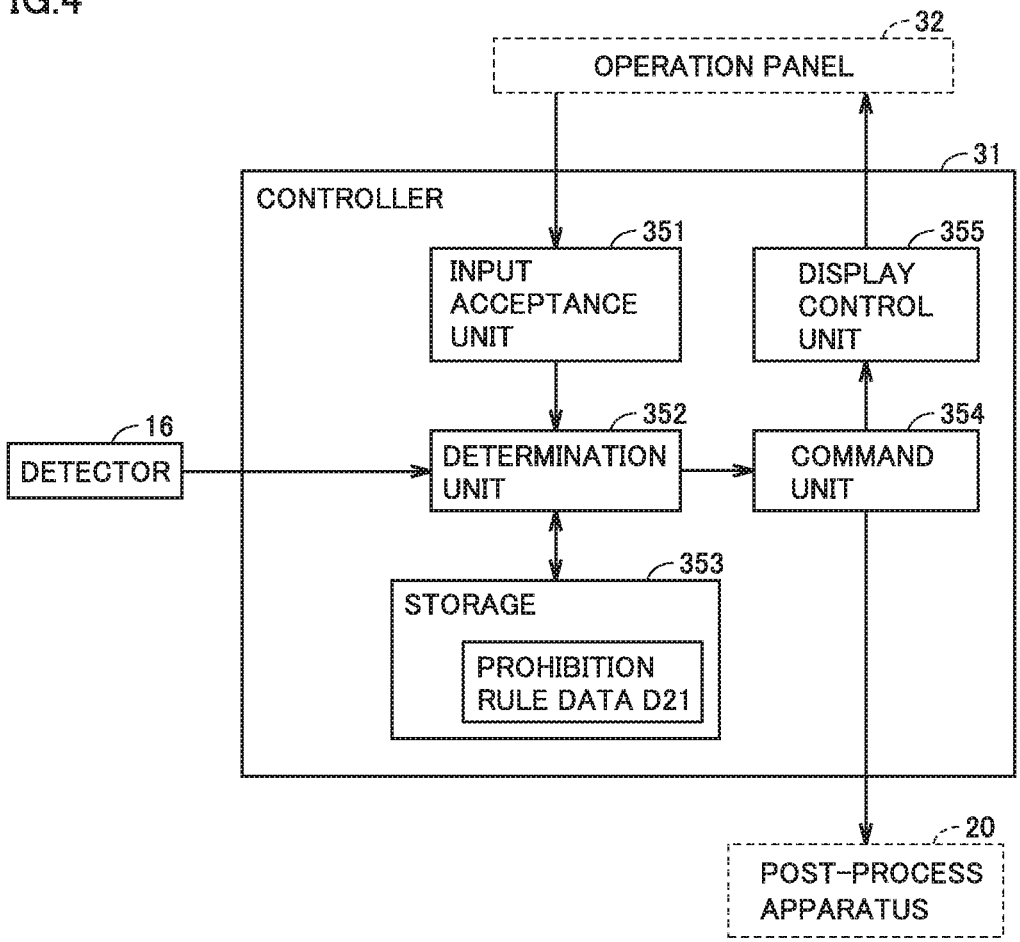
FIG. 4 is a block diagram showing a functional configuration of a controller.

FIG. 4 is a block diagram showing a functional configuration of controller 31.

Referring to FIG. 4, controller 31 includes an input acceptance unit 351, a determination unit 352, a storage 353, a command unit 354, and a display control unit 355.

Input acceptance unit 351 accepts input based on an operation by a user performed on operation panel 32. By way of example of input, input acceptance unit 351 accepts input for designating a post-process to be performed by post-process apparatus 20 among a plurality of types of post-processes. Alternatively, input acceptance unit 351 accepts designation of the number of copies to be printed through operation panel 32.

Storage 353 stores in advance prohibition rule data D21 (see FIG. 2).

Determination unit 352 receives from input acceptance unit 351, information representing at designated post-process (type information). Determination unit 352 receives from detector 16 for each sheet of paper P, information on a basis weight of paper P in the present example by way of example of an attribute of paper.

Determination unit 352 determines for each sheet of paper P, whether or not the designated post-process is prohibited based on prohibition rule data D21 and the detected basis weight. In the present example, when determination unit 352 determines that paper bundle B includes paper P having attribute Z2 by referring to prohibition rule data D21, it prohibits the side-stitching process in principle.

When determination unit 352 determines that the designated post-process is prohibited, it determines whether paper P which resulted in determination as prohibition is the first sheet of paper, an intermediate sheet of paper, or the last sheet of paper in paper bundle B (a group of paper).

Controller 31 has a function to determine whether each sheet of paper P is the first sheet of paper, an intermediate sheet of paper, and the last sheet of paper in paper bundle B. For example, when a user inputs an instruction to generate ten sets of copies of six sheets of paper to image forming apparatus 10 as described above, controller 31 has a function to determine, for each set, whether each sheet of paper P is the first sheet of paper, an intermediate sheet of paper, or the last sheet of paper among the six sheets of paper. With this function, determination unit 352 determines whether paper P which resulted in determination as prohibition is the first sheet of paper, an intermediate sheet of paper, or the last sheet of paper in paper bundle B as described above.

Command unit 354 has image forming system 1000 perform a process (processes Q1, Q2, and Q3 in FIG. 2) in accordance with a result of determination made by determination unit 352. In one aspect, command unit 354 has image forming apparatus 10 perform a process in accordance with a result of determination. In another aspect, command unit 354 changes a process to be performed by post-process apparatus 20 as the process in accordance With the result of determination.

When determination unit 352 determines that a post-process is prohibited, command unit 354 sends a prescribed command to display control unit 355. When display control unit 355 accepts the command, it has display 322 of operation panel 32 show a warning.

Contents of processing will be described below more specifically with reference to flowcharts shown in FIGS. 5 to 7.

<E. Control Structure>

Figure 5:
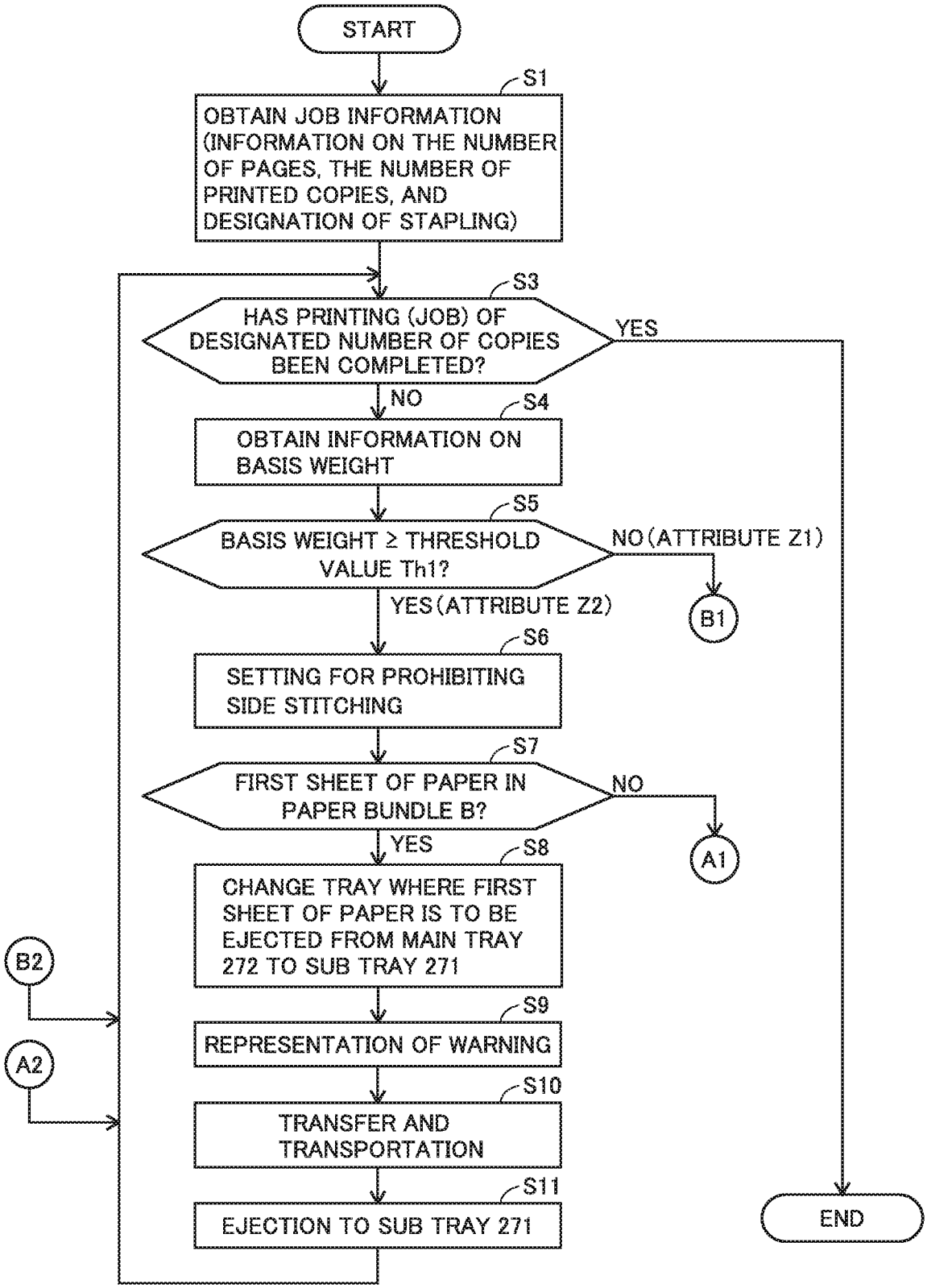
FIG. 5 is a flowchart for illustrating a flow of processing performed in the image forming system.

FIG. 5 is a flowchart for illustrating a flow of processing performed in image forming system 1000. An example in which a user sets the side-stitching process as described above will be described by way of example.

Referring to FIG. 5, in step S1, controller 31 obtains job information from operation panel 32 or another communication instrument. The job information includes various types of information such as the number of pages, the number of printed copies, or designation of a post-process. In step S3, controller 31 determines whether or not printing of the designated number of copies has been completed.

When controller 31 determines that printing of the designated number of copies has been completed (YES in step S3), it quits a series of processing. When controller 31 determines that printing of the designated number of copies has not been completed (NO in step S3), it obtains from detector 16 in step S4, information on a basis weight of one sheet of paper P on which image is to be formed.

In step S5, controller 31 determines whether or not a basis weight is equal to or greater than a threshold value Th1. This processing corresponds to determination as to whether or not paper P has attribute Z2 in the example in FIG. 2.

When controller 31 determines that the basis weight is equal to or greater than threshold value Th1 (YES in step S5), it makes setting to prohibit the side-stitching process by referring to prohibition rule data D21 in step S6. In the example in FIG. 2, threshold value Th1 is set to "158 g/m$^2$".

Figure 7:
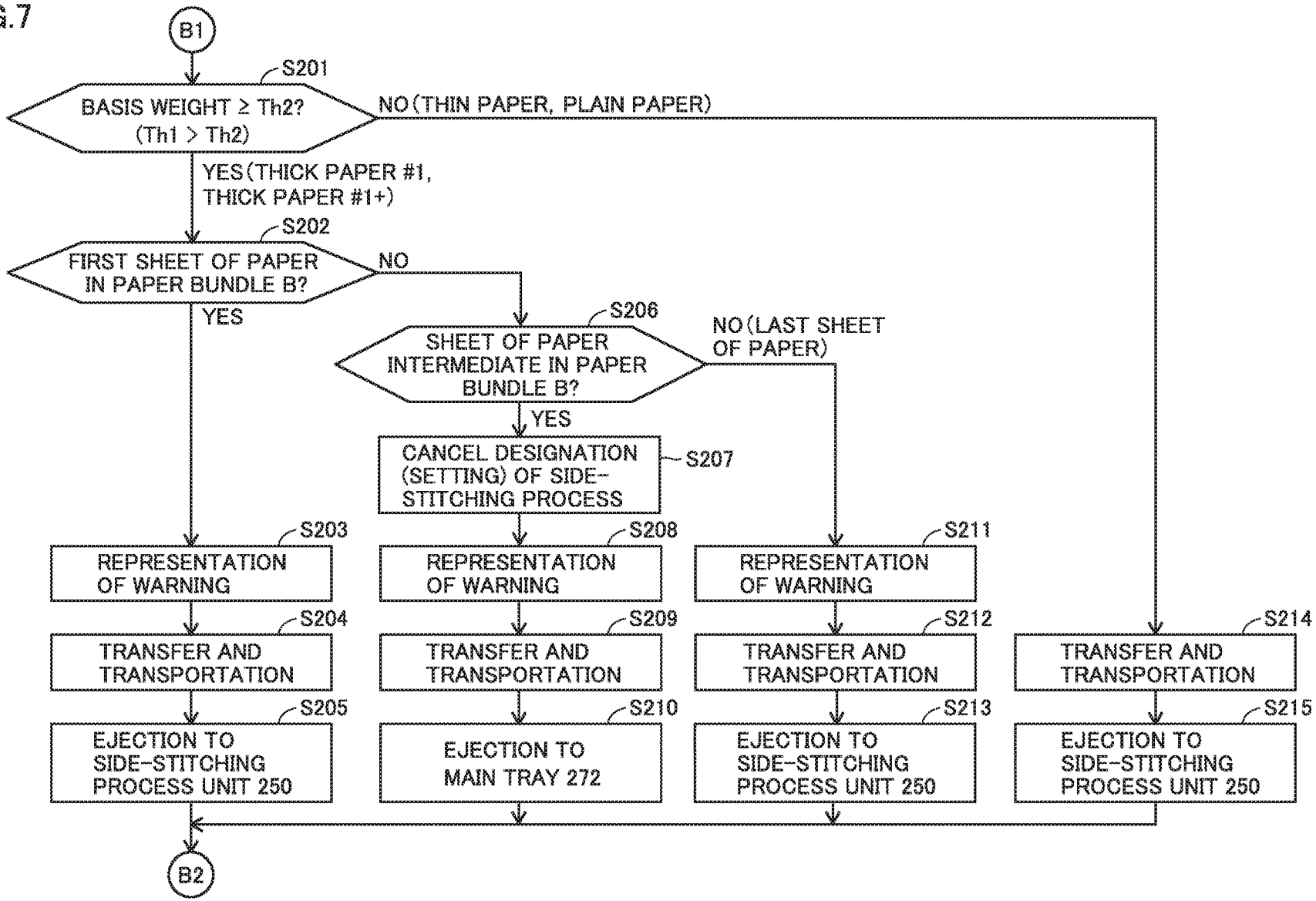
FIG. 7 is a flowchart for illustrating processing after determination as NO is made in step S5 in FIG. 5.

When controller 31 determines that the basis weight is smaller than threshold value Th1 (NO in step S5), the process proceeds to step S201 shown in FIG. 7. Processing in FIG. 7 will be described later.

In step S7, controller 31 determines whether or not paper P having a basis weight equal to or greater than threshold value Th1 is the first sheet of paper in paper bundle B. When controller 31 determines that the paper is not the first sheet of paper (NO in step S7), the process proceeds to step S101 in FIG. 6. Processing in FIG. 6 will be described later. When controller 31 determines that the paper is the first sheet of paper (YES in step S7), it changes a tray to which paper P (that is, the first sheet of paper) is to be ejected from a default tray to another tray in step S8. Specifically, controller 31 changes the ejection tray from main tray 272 to sub tray 271.

In step S9, controller 31 has display 322 of operation panel 32 show a warning. For example, controller 31 has display 322 show that paper P is not in conformity with a printing mode. The warning is suitably given, for example, by showing a message indicating to a user that error paper was ejected and inviting the user to change paper.

In step S10, controller 31 performs a transfer process and a transportation process on the first sheet of paper P. In step S11, controller 31 has the first sheet of paper ejected to sub tray 271. Thereafter, the process proceeds to step S3.

As set forth above, when controller 31 determines that a designated post-process (in this case, the side-stitching process) is prohibited and when paper P which resulted in determination as prohibition is the first sheet of paper in paper bundle B, it has paper P which resulted in determination as prohibition ejected to sub tray 271. Processing for changing a tray to which paper P having attribute Z2 is to be ejected from main tray 272 to sub tray 271 corresponds to process Q1 in the example in FIG. 2.

When determination as YES is made in step S7 as above, paper bundle B including paper (paper having a basis weight equal to or greater than threshold value Th1) which resulted in determination as prohibition of the post-process is not subjected to the side-stitching process. In order not to probibit the side-stitching process on paper bundle B subsequent to paper bundle B in common, controller 31 does not cancel setting of the side-stitching process per se.

The reason why the ejection tray is changed from main tray 272 to sub tray 271 in step S8 is as below. Since paper P is at the top of the paper bundle (set), it may be determined that the post-process onto paper P subsequent to paper P is not prohibited. Therefore, a job is continued without cancelling setting of the post-process. If paper P is transported to side-stitching process unit 250, however, paper P of which post-process has been determined as prohibited will be mixed in paper bundle B. Therefore, the tray where paper P is to be ejected is changed to sub tray 271 different from main tray 272 where side-stitching is performed.

Figure 6:
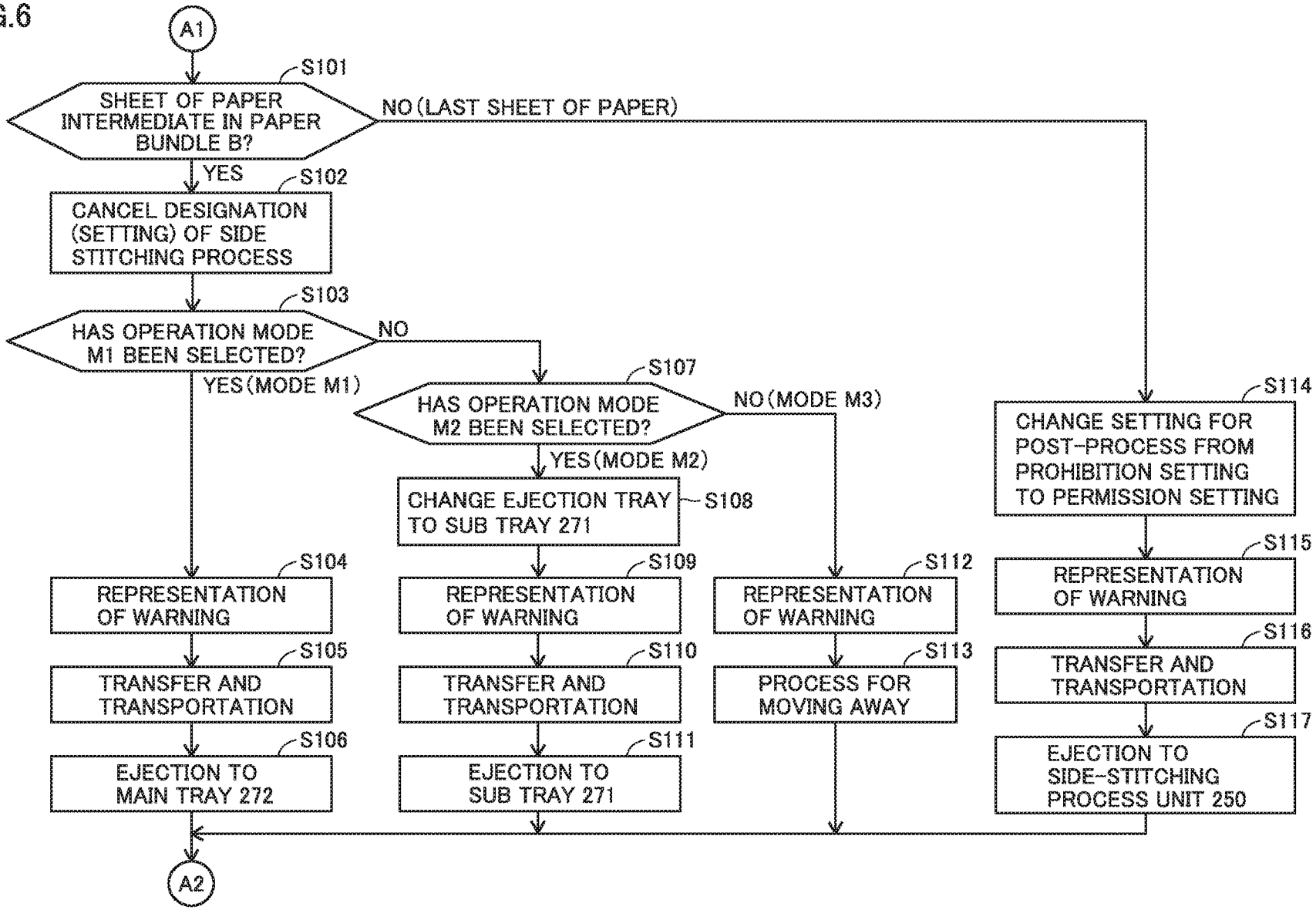
FIG. 6 is a flowchart for illustrating processing after determination as NO is made in step S7 in FIG. 5.

FIG. 6 is a flowchart for illustrating processing after determination as NO is made in step S7 in FIG. 5.

Referring to FIG. 6, in step S101, controller 31 determines whether or not paper P having the basis weight equal to or greater than threshold value Th1 is a sheet of paper intermediate in paper bundle B. When controller 31 determines that the paper is an intermediate sheet of paper (YES in step S101), it cancels designation (setting) of the side-stitching process in step S102. When controller 31 determines that paper is not an intermediate sheet of paper (that is, the last sheet of paper) (NO in step S101), the process proceeds to step S114.

After step S102, controller 31 determines in step S103 whether or not an operation mode M1 has been selected from among three predetermined operation modes M1, M2, and M3. Selection of an operation mode may typically be made in advance by a user. Alternatively, for selection on the spot, representation on touch screen 320 may be provided.

When a user desires ejection of an intermediate sheet of paper P between sheets of paper in paper bundle B (that is, use as a slip sheet is desired), operation mode M1 is selected. When the user does not desire ejection of paper P between sheets of paper in paper bundle B, that is, desires to prevent paper different in type from being mixed in paper bundle B, an operation mode M2 is selected. Though there is no choice of an ejection tray in a post-process apparatus including only a single ejection tray, an operation mode M3 is selected when continuation of a subsequent job is desired.

When controller 31 determines that operation mode M1 has been selected (YES in step S103), it has display 322 show a warning in step S104. In step S105, controller 31 subjects the intermediate sheet of paper to the transfer process and the transportation process. In step S106, the intermediate sheet of paper is ejected to main tray 272.

When controller 31 determines that operation mode M1 has not been selected (NO in step S103), it determines in step S107 whether or not operation mode M2 has been selected. When controller 31 determines that operation mode M2 has been selected (YES in step S107), it changes a tray where the intermediate sheet of paper is to be ejected from main tray 272 to sub tray 271 in step S108.

Controller 31 has display 322 show a warning in step S109. In step S110, controller 31 subjects the intermediate sheet of paper to the transfer process and the transportation process. In step S111, the intermediate sheet of paper is ejected to sub tray 271.

When controller 31 determines that operation mode M2 has not been selected (that is, operation mode M3 has been selected) (NO in step S107), it has display 322 show a warning in step S112.

In step S113, controller 31 performs a process for moving away the intermediate sheet of paper (that is, paper P which resulted in determination as prohibition of the side stitching process). Specifically, controller 31 has the intermediate sheet of paper moved away to a prescribed position in reverse transportation path 17. Controller 31 has the intermediate sheet of paper moved away to a transportation path different from transportation path 15 through which the first sheet of paper has passed.

In step S114, controller 31 changes setting for the post-process from prohibition setting to permission setting. In step S115, controller 31 has display 322 show a warning. In step S116, controller 31 subjects the last sheet of paper to the transfer process and the transportation process. In step S117, on condition that the first sheet of paper and the intermediate sheet of paper have been ejected to side-stitching process unit 250, controller 31 has the last sheet of paper ejected to side-stitching process unit 250. In this case, side-stitching process unit 250 performs the side-stitching process (the stapling process) on paper bundle B including the last sheet of paper.

As set forth above, when paper having the basis weight equal to or greater than threshold value Th1 is a sheet of paper intermediate in paper bundle B (that is, determination as YES is made in step S101) as well, paper bundle B including, paper having the basis weight equal to or greater than threshold value Th1 (paper which resulted in determination as prohibition of the post-process) is not subjected to the side-stitching process.

On the other hand, when paper having the basis weight equal to or greater than threshold value Th1 is the last sheet of paper in paper bundle B (only the last sheet of paper) (that is, determination as NO is made in step S101) as well, paper bundle B including paper having the basis weight equal to or greater than threshold value Th1 (paper which resulted in determination as prohibition of the post-process) is subjected to the side-stitching process. This is because a user may intend that "the last sheet of paper is a back cover and the paper is to be subjected to the side-stitching process."

Processing described with reference to FIG. 6 will be summarized below.

(1) With attention being paid to an example in which operation mode M1 is set (YES in step S103), the example is as follows. When controller 31 determines that a designated post-process (the side stitching process) is prohibited and paper P which resulted in determination as prohibition is a sheet of paper intermediate in paper bundle B, paper P which resulted in determination as prohibition and paper other than paper P which resulted in determination as prohibition are ejected to main tray 272. Controller 31 controls post-process apparatus 20 to have all sheets of paper P included in paper bundle B ejected to main tray 272.

(2) With attention being paid to an example in which operation mode M2 is set (YES in step S107), the example is as follows. When controller 31 determines than the designated post-process (the side-stitching process) is prohibited and paper P which resulted in determination as prohibition is a sheet of paper intermediate in paper bundle B, it has paper which resulted in determination as prohibition ejected to sub tray 271 and has paper other than the paper which resulted in determination as prohibition ejected to main tray 272.

(3) When paper P which resulted in determination as prohibition is a sheet of paper intermediate in paper bundle B, controller 31 cancels designation (setting) of the post-process (the side-stitching process) as shown in step S102.

(4) With attention being paid to an example in which operation mode M3 is set (NO in step S107), the example is as follows. When controller 31 determines that the designated post-process (the side-stitching process) is prohibited and paper P which resulted in determination as prohibition is a sheet of paper intermediate in paper bundle B, it has paper which resulted in determination as prohibition moved away to a prescribed position in reverse transportation path 17. Reverse transportation path 17 is a path different from transportation path 15 through which the first sheet of paper (paper having the basis weight smaller than threshold value Th1) has passed.

(5) With attention being paid to an example in which determination as the last sheet of paper has been made (NO in step S101), the example is as follows. In spite of determination by controller 31 that the designated post-process (the side-stitching process) is prohibited, when paper P which resulted in determination as prohibition is the last sheet of paper in paper bundle B, it has the post-process (the side-stitching process) performed regardless of the determination.

FIG. 7 is a flowchart for illustrating processing after determination as NO is made in step S5 in FIG. 5.

Referring to FIG. 7, in step S201, controller 31 further determines whether or not paper P determined to have the basis weight smaller than threshold value Th1 has the basis weight equal to or greater than a threshold value Th2. Th2 is smaller in value than Th1.

In the example in FIG. 2, threshold value Th2 can be set, for example, to "91 g/m$^2$." In this case, for paper having attribute Z1, "thick paper #1" and "thick paper #1+" are determined to have the basis weight equal to or greater than threshold value Th2.

When controller 31 determines that paper P has the basis weight equal to or greater than threshold value Th2 (YES in step S201), it determines in step S202 whether or not paper P is the first sheet of paper in paper bundle B.

When controller 31 determines that paper P is the first sheet of paper (YES in step S202), it has display 322 show a warning in step S203. In step S204, controller 31 subjects paper P to the transfer process and the transportation process. In step S205, controller 31 has paper P ejected to side-stitching process unit 250.

When controller 31 determines that paper P is not the first sheet of paper (NO in step S202), it determines in step S206 whether or not paper P is a sheet of paper intermediate in paper bundle B. When controller 31 determines the paper as the intermediate sheet of paper (YES in step S206), it cancels designation (setting) of the side-stitching process in step S207.

In step S208, controller 31 has display 322 show a warning. In step S209, controller 31 subjects paper P to the transfer process and the transportation process. In step S210, controller 31 has paper P ejected to main tray 272. Controller 31 may be set to have paper P ejected to sub tray 271.

When controller 31 determines that the paper is not an intermediate sheet of paper (that is, the last sheet of paper) (NO in step S206), it has display 322 show a warning in step S211 without canceling designation (setting) of the side-stitching process. In step S212, controller 31 subjects paper P to the transfer process and the transportation process. In step S213, controller 31 has paper P ejected to side-stitching process unit 250. In this case, on condition that all sheets of paper P in paper bundle B have been ejected to side-stitching process unit 250, side-stitching process unit 250 performs the side-stitching process.

When controller 31 determines that paper P has the basis weight smaller than threshold value Th2 (NO in step S201), it subjects paper P determined to have the basis weight smaller than threshold value Th2 to the transfer process and the transportation process in step S214. Controller 31 has paper P ejected to side stitching process unit 250 in step S215. In this case, on condition that all sheets of paper P in paper bundle B have been ejected to side-stitching process unit 250, side-stitching process unit 250 performs the side-stitching process.

In steps S203, S208, and S211, controller 31 has display 322 show, for example, that "thick paper #1" and "thick paper #1+" are included.

Processing described with reference to FIG. 7 will be summarized below.

(1) As described with reference to FIG. 5, controller 31 determines that a designated post-process (the side-stitching process) is prohibited on condition that the basis weight is greater than threshold value Th1. Controller 31 determines that the designated post-process is not prohibited (permitted) on condition that the basis weight is smaller than threshold value Th1. Controller 31 has post-process apparatus 20 perform processes different between an example in which the basis weight is smaller than threshold value Th1 and greater than threshold value Th2 and an example in which the basis weight is smaller than threshold value Th2.

(2) When controller 31 determines that the designated post-process (the side-stitching process) is not prohibited, it has display 322 show a predetermined warning on condition that the basis weight is smaller than threshold value Th1 and greater than threshold value Th2.

(3) When controller 31 determines that the designated post-process (the side-stitching process) is not prohibited and when paper determined to have the basis weight smaller than threshold value Th1 and greater than threshold value Th2 is a sheet of paper intermediate in paper bundle B, it cancels designation of the post-process.

Though description is given in the present example with attention being paid to the side-stitching process, limitation thereto is not required and other post-processes (shifting, punching, the saddle-stitching process, and the folding process) or combination of a plurality of types of post-processes is also applicable.

<F. Advantage>

Image forming system 1000 includes detector 16 and can selectively change a post-process, where paper is to be ejected, and representation of a warning based on a basis weight of paper P detected by detector 16, a position of paper P in paper bundle B, and a set printing mode.

In the processing example shown in FIG. 5, paper P which resulted in determination as prohibition of a post-process is the first sheet of paper (the top sheet of paper) in paper bundle B. Therefore, paper bundle B subsequent to paper bundle B including paper P may not include paper which will result in determination as prohibition. From such a point of view, controller 31 continues a job without canceling setting of the post process. A user is thus prevented from being bothered by setting again a printing mode.

As shown in FIG. 6, controller 31 can have different processes performed between an example in which paper having the basis weight equal to or greater than threshold value Th1 is a sheet of paper intermediate in paper bundle B and an example in which the paper is the last sheet of paper. In addition, when the user selects a desired operation mode from among operation modes M1, M2, and M3, the user can make processes to be performed by image forming system 1000 different.

In particular, when paper having a basis weight equal to or greater than threshold value Th1 is the last sheet of paper in paper bundle B, controller 31 changes setting of the post-process from prohibition setting to permission setting (see step S114). Therefore, the controller can have a post-process performed on paper bundle B including such paper P.

As shown in FIG. 7, when a basis weight is equal to or greater than threshold value Th2 even though the basis weight is equal to or smaller than threshold value Th1, controller 31 can have image forming system 1000 perform a process different from a process performed when the basis weight is smaller than threshold value Th1. For example, controller 31 can have post-process apparatus 20 or image forming apparatus 10 perform processes different between an example of thick paper #1 and thick paper #1+ and an example of thin paper and plain paper.

<G. Modification>

(1) Though a configuration in which, when controller 31 determines that a designated post-process is prohibited, it determines whether paper P (paper having the basis weight equal to or greater than threshold value Th1) which resulted in determination as prohibition is the first sheet of paper, an intermediate sheet of paper, or the last sheet of paper in paper bundle B (a group of paper) is described above by way of example, limitation thereto is not intended. For example, controller 31 may be configured such that, when the controller determines that a designated post-process is prohibited, it determines whether or not paper which resulted in determination as prohibition is a sheet of paper intermediate between the first sheet of paper and the last sheet of paper in paper bundle B. Namely, controller 31 may be configured to determine whether or not paper is an intermediate sheet of paper.

(2) Controller 31 is preferably configured to determine, on condition that a predetermined operation mode has been set, whether paper which resulted in determination as prohibition is the first sheet of paper, the last sheet of paper, or a sheet of paper intermediate in paper bundle B and to have image forming system 1000 perform a process in accordance with a result of determination.

(3) Controller 31 may be configured as below. Controller 31 stores the maximum number of sheets of paper allowed to be subjected to a post-process for each designated post-process. When the basis weight is smaller than threshold value Th1 and greater than threshold value Th2 even though controller 31 determines that the designated post-process is not prohibited, controller 31 determines whether or not to perform the designated post-process based on the number of sheets of paper in paper bundle B (the number of sheets of paper in a group of paper) and the maximum number of sheets of paper.

Whether or not to perform a post-process may thus be set in accordance with the number of sheets of paper P included in each set. Controller 31 typically stores in advance the maximum number of sheets of paper as a numeric value associated with post-process apparatus 20.

(4) Controller 31 may be configured such that, when the controller determines that the designated post-process is prohibited, paper P which resulted in determination as prohibition is ejected from post-process apparatus 20 without an image being formed thereon.

(5) Controller 31 may be configured such that, when the controller determines that the designated post-process is prohibited, it has the image for apparatus notify that the post-process is unexecutable. Such notification may be a representation on display 322 or output from a not-shown speaker provided in image forming apparatus 10.

(6) Controller 31 may be configured such that, when the controller determines that the designated post-process is not prohibited, on condition that the basis weight is smaller than threshold value Th1 and greater than threshold value Th2, the controller accepts input for selection as to whether or not to perform the post-process (input based on an operation by a user).

<Summary>

According to one aspect of the present disclosure, an image forming system includes an image forming apparatus and a post-process apparatus configured to perform a designated post-process among a plurality of types of post-processes. The image forming apparatus includes a controller configured to control the image forming apparatus and the post-process apparatus and a detector configured to detect an attribute of paper fed from the image forming apparatus to the post-process apparatus for each sheet of paper. The post-process apparatus is configured to perform a post-process for each group of paper including a designated number of sheets of paper. The controller is configured to store prohibition rule data which defines permission and prohibition of the post-process in accordance with the attribute of the paper for each type of the post-process. The controller is configured to accept input of designation of a post-process to be performed by the post-process apparatus among the plurality of types of post-processes. The controller is configured to determine for each sheet of the paper, whether or not the designated post-process is prohibited based on the prohibition rule data and the detected attribute of the paper. The controller is configured to determine, when the controller determines that the designated post-process is prohibited, whether or not paper which resulted in determination as the prohibition is a sheet of paper intermediate between a first sheet of paper and a last sheet of paper in the group of paper and have the image forming system perform a process in accordance with a result of determination.

Preferably, the controller is configured to change a process to be performed by the post-process apparatus as the process in accordance with the result of determination.

Preferably, the attribute of the paper is at least one of a type of the paper, a thickness of the paper, and a basis weight of the paper.

Preferably, the controller is configured to determine whether the paper which resulted in determination as the prohibition is the first sheet of paper, the intermediate sheet of paper, or the last sheet of paper and to have the image forming system perform a process in accordance with the result of determination.

Preferably, the image forming system further includes a first ejection tray and a second ejection tray. When the controller determines that the designated post-process is prohibited and the paper which resulted in determination as the prohibition is the first sheet of paper, the controller is configured to eject the paper which resulted in determination as the prohibition to the first ejection tray and to eject paper other than the paper which resulted in determination as the prohibition in the group of paper to the second ejection tray.

Preferably, when the controller determines that the designated post-process is prohibited and the paper which resulted in determination as the prohibition is the intermediate sheet of paper, the controller is configured to eject the paper which resulted in determination as the prohibition and paper other than the paper which resulted in determination as the prohibition to the second ejection tray.

Preferably, when the controller determines that the designated post-process is prohibited and the paper which resulted in determination as the prohibition is the intermediate sheet of paper, the controller is configured to eject the paper which resulted in determination as the prohibition to the first ejection tray and to eject paper other than the paper which resulted in determination as the prohibition to the second ejection tray.

Preferably, when the paper which resulted in determination as the prohibition is the intermediate sheet of paper, the controller is configured to cancel designation of the post-process.

Preferably, when the controller determines that the designated post-process is prohibited and the paper which resulted in determination as the prohibition is the intermediate sheet of paper, the controller is configured to move the paper which resulted in determination as the prohibition away to a prescribed position in a transportation path.

Preferably, the prescribed position is a position in the transportation path different from a transportation path through which the first sheet of paper has passed.

Preferably, in spite of determination by the controller that the designated post-process is prohibited, when the paper which resulted in determination as the prohibition is the last sheet of paper, the controller is configured to have the post-process performed regardless of that determination.

Preferably, the attribute of the paper is a thickness of the paper or a basis weight of the paper. The detector outputs the attribute of the paper as a numeric value. The controller is configured to determine that the designated post-process is prohibited on condition that the numeric value is greater than a first threshold value. The controller is configured to determine that the designated post process is not prohibited on condition that the numeric value is smaller than the first threshold value. The controller is configured to have the post-process apparatus perform processes different between an example in which the numeric value is smaller than the first threshold value and greater than a second threshold value and an example in which the numeric value is smaller than the second threshold value.

Preferably, the image forming system further includes a display. When the controller determines that the designated post-process is not prohibited, the controller is configured to have the display show a predetermined warning on condition that the numeric value is smaller than the first threshold value and greater than the second threshold value.

Preferably, when the controller determines that the designated post-process is not prohibited and paper of which numeric value is determined as being smaller than the first threshold value and greater than the second threshold value is the intermediate sheet of paper, the controller is configured to cancel designation of the post-process.

Preferably, on condition that a predetermined operation mode has been set, the controller is configured to determine whether the paper which resulted in determination as the prohibition is the first sheet of paper, the last sheet of paper, or the intermediate sheet of paper and to have the image forming system perform a process in accordance with a result of that determination.

Preferably, the controller is configured to store a maximum number of sheets of paper which application of the post-process is allowed for each designated post-process. In spite of determination by the controller that the designated post-process is not prohibited, when the numeric value is smaller than the first threshold value and greater than the second threshold value, the controller is configured to determine whether or not to perform the designated post-process based on the number of sheets of paper in the group of paper and the maximum number of sheets of paper.

Preferably, the controller is configured to store the maximum number of sheets of paper as numeric value associated with the post-process apparatus.

Preferably, when the controller determines that the designated post-process is prohibited, the controller is configured to have the paper which resulted in determination as the prohibition ejected from the post-process apparatus without forming an image thereon.

Preferably, the post-process apparatus performs at least one of shifting, punching, stitching, and folding as the post-process.

Preferably, when the controller determines that the designated post-process is prohibited, the controller is configured to have the image forming apparatus notify that the post-process is unexecutable.

Preferably, when the controller determines that the designated post-process is not prohibited, the controller is configured to accept input for selecting whether or not to perform the post-process on condition that the numeric value is smaller than the first threshold value and greater than the second threshold value.

According to another aspect of the present disclosure, a control method is performed in an image forming system including an image forming apparatus and a post-process apparatus configured to perform a designated post-process among a plurality of types of post-processes for each group of paper including a designated number of sheets of paper. The control method includes detecting an attribute of paper fed from the image forming apparatus to the post-process apparatus for each sheet of paper, accepting input of designation of a post-process to be performed by the post-process apparatus among the plurality of types of post-processes, determining for each sheet of paper, whether or not the designated post-process is prohibited based on prohibition rule data and the detected attribute of the paper, the prohibition rule data defining permission and prohibition of the post-process in accordance with the attribute of the paper for each type of the post-process, and determining, when it is determined that the designated post-process is prohibited, whether paper which resulted in determination as the prohibition is a sheet of paper intermediate between a first sheet of paper and a last sheet of paper in the group of paper and having the image forming system perform a process in accordance with a result of determination.

Although embodiments of the present invention have been described and illustrated in detail, the disclosed embodiments are made for the purposes of illustration and example only and not limitation. The scope of the present invention should be interpreted by terms of the appended claims.

What is claimed is:

1. An image forming system comprising:

an image forming apparatus; and a post-process apparatus configured to perform a designated post-process among a plurality of types of post-processes, the image forming apparatus including a controller configured to control the image forming apparatus and the post-process apparatus, and a detector configured to detect an attribute of paper fed from the image forming apparatus to the post-process apparatus for each sheet of paper, the post-process apparatus being configured to perform a post-process for each group of paper including designated number of sheets of paper, the controller being configured to store prohibition rule data which defines permission and prohibition of the post-process in accordance with the attribute of the paper for each type of the post-process, accept input of designation of a post-process to be performed by the post-process apparatus among the plurality of types of post-processes, determine for each sheet of the paper, whether the designated post-process is prohibited based on the prohibition rule data and the detected attribute of the paper, and determine, when the controller determines that the designated post-process is prohibited, whether paper which resulted in determination as the prohibition is a sheet of paper intermediate between a first sheet of paper and a last sheet of paper in the group of paper and have the image forming system perform a process in accordance with a result of determination.

2. The image forming system according to claim 1, wherein the controller is configured to change a process to be performed by the post-process apparatus as the process in accordance with the result of determination.

3. The image forming system according to claim 1, wherein the attribute of the paper is at least one of a type of the paper, a thickness of the paper, and a basis weight of the paper.

4. The image forming system according to claim 1, wherein the controller is configured to determine whether the paper which resulted in determination as the prohibition is the first sheet of paper, the intermediate sheet of paper, or the last sheet of paper, and to have the image forming system perform a process in accordance with the result of determination.

5. The image forming system according to claim 4, the image forming system further comprising a first ejection tray and a second ejection tray, wherein when the controller determines that the designated post process is prohibited and the paper which resulted in determination as the prohibition is the first sheet of paper, the controller is configured to eject the paper which resulted in determination as the prohibition to the first ejection tray and to eject paper other than the paper which resulted in determination as the prohibition in the group of paper to the second ejection tray.

6. The image forming system according to claim 5, wherein when the controller determines that the designated post process is prohibited and the paper which resulted in determination as the prohibition is the intermediate sheet of paper, the controller is configured to eject the paper which resulted in determination as the prohibition and paper other than the paper which resulted in determination as the prohibition to the second ejection tray.

7. The image forming system according to claim 5, wherein when the controller determines that the designated post-process is prohibited and the paper which resulted in determination as the prohibition is the intermediate sheet of paper, the controller is configured to eject the paper which resulted in determination as the prohibition to the first ejection tray and to eject paper other than the paper which resulted in determination as the prohibition to the second ejection tray.

8. The image forming system according to claim 6, wherein when the paper which resulted in determination as the prohibition is the intermediate sheet of paper, the controller is configured to cancel designation of the post-process.

9. The image forming system according to claim 4, wherein when the controller determines that the designated post-process is prohibited and the paper which resulted in determination as the prohibition is the intermediate sheet of paper, the controller is configured to move the paper which resulted in determination as the prohibition away to a prescribed position in a transportation path.

10. The image forming system according to claim 9, wherein the prescribed position is a position in the transportation path different from a transportation path through which the first sheet of paper has passed.

11. The image forming system according to claim 4, wherein in spite of determination by the controller that the designated post-process is prohibited, when the paper which resulted in determination as the prohibition is the last sheet of paper, the controller is configured to have the post-process performed regardless of that determination.

12. The image forming system according to claim 1, wherein the attribute of the paper is a thickness of the paper or a basis weight of the paper, the detector outputs the attribute of the paper as a numeric value, the controller is configured to determine that the designated post-process is prohibited on condition that the numeric value is greater than a first threshold value, determine that the designated post-process is not prohibited on condition that the numeric value is smaller than the first threshold value, and have the post-process apparatus perform processes different between an example in which the numeric value is smaller than the first threshold value and greater than a second threshold value and an example in which the numeric value is smaller than the second threshold value.

13. The image forming system according to claim 12, the image forming system further comprising a display, wherein when the controller determines that the designated post process is not prohibited, the controller is configured to have the display show a predetermined warning on condition that the numeric value is smaller than the first threshold value and greater than the second threshold value.

14. The image forming system according to claim 12, wherein when the controller determines that the designated post-process is not prohibited and paper of which numeric value is determined as being smaller than the first threshold value and greater than the second threshold value is the intermediate sheet of paper, the controller is configured to cancel designation of the post-process.

15. The image forming system according to claim 4, wherein on condition that a predetermined operation mode has been set, the controller is configured to determine whether the paper which resulted in determination as the prohibition is the first sheet of paper, the last sheet of paper, or the intermediate sheet of paper and to have the image forming system perform a process in accordance with a result of that determination.

16. The image forming system according to claim 13, wherein the controller is configured to store a maximum number of sheets of paper on which application of the post-process is allowed for each designated post-process, and in spite of determination the controller that the designated post-process is not prohibited, determine whether to perform the designated post-process based on the number of sheets of paper in the group of paper and the maximum number of sheets of paper when the numeric value is smaller than the first threshold value and greater than the second threshold value.

17. The image forming system according to claim 16, wherein the controller is configured to store the maximum number of sheets of paper as a numeric value associated with the post-process apparatus.

18. The image forming system according to claim 1, wherein when the controller determines that the designated post-process is prohibited, the controller is configured to have the paper which resulted in determination as the prohibition ejected from the post-process apparatus without forming an image on that paper.

19. The image forming system according to claim 1, wherein the post-process apparatus performs at least one of shifting, punching, stitching, and folding as the post-process.

20. The image forming system according to claim 1, wherein when the controller determines that the designated post-process is prohibited, the controller is configured to have the image forming apparatus notify at the post-process is unexecutable.

21. The image forming system according to claim 13, wherein when the controller determines that the designated post-process is not prohibited, the controller is configured to accept input for selecting whether to perform the post-process on condition that the numeric value is smaller than the first threshold value and greater than the second threshold value.

22. A control method performed in an image forming system including an image forming apparatus and a post-process apparatus configured to perform a designated post-process among a plurality of types of post-processes for each group of paper including a designated number of sheets of paper, the control method comprising:

detecting an attribute of paper fed from the image forming apparatus to the post-process apparatus for each sheet of paper;

accepting input of designation of a post-process to be performed by the post-process apparatus among the plurality of types of post-processes;

determining for each sheet of paper, whether the designated post-process is prohibited based on prohibition rule data and the detected attribute of the paper, the prohibition rule data defining permission and prohibition of the post-process in accordance with the attribute of the paper for each type of the post-process; and determining, when it is determined that the designated post-process is prohibited, whether paper which resulted in determination as the prohibition is a sheet of paper intermediate between a first sheet of paper and a last sheet of paper in the group of paper and having the image forming system perform a process in accordance with a result of determination.

* * * * *